US005105648A

United States Patent [19]

Steiner et al.

[11] Patent Number: 5,105,648

[45] Date of Patent: Apr. 21, 1992

[54] MOLDED LIGHTWEIGHT HANDTOOL WITH STRUCTURAL INSERT

[75] Inventors: Richard A. Steiner, East Haddam; Charles J. Gargano, Guilford, both of Conn.

[73] Assignee: Rostra Tool Company, Branford, Conn.

[21] Appl. No.: 652,469

[22] Filed: Feb. 7, 1991

Related U.S. Application Data

[63] Continuation-in-part of Ser. No. 482,210, Feb. 16, 1990, abandoned.

[51] Int. Cl.[5] ..... H01R 43/042

[52] U.S. Cl. ..... 72/410; 29/751; 81/418; 81/427.5; 81/900

[58] Field of Search ..... 72/410, 409, 451; 29/751, 753; 81/900, 427.5, 418, 355, 361, 362, 363, 128, 313

[56] References Cited

U.S. PATENT DOCUMENTS 3,082,652 3/1963 Marti ..... 81/427.5
3,204,445 9/1965 Filia ..... 72/410
4,144,738 3/1979 Dziura ..... 72/410
4,713,874 12/1987 Schwartz ..... 29/751
4,794,780 1/1989 Battenfield ..... 29/751

FOREIGN PATENT DOCUMENTS 1033112 6/1966 United Kingdom ..... 72/410

OTHER PUBLICATIONS

P. 24 of brochure by Daniels Manufacturing Corp., 6103 Anno Avenue, Orlando, Fla. 32809. Date unknown, but precedes applicants' invention.

*Primary Examiner*—Daniel C. Crane
*Attorney, Agent, or Firm*—John H. Crozier

[57] ABSTRACT

In a preferred embodiment, a handtool for crimping electrical connectors onto the ends of cables or similar operations, which handtool has major portions thereof constructed of a polymeric material. A metal structural insert is provided within the polymeric material to contain substantially all of the stresses developed by the crimping operations.

6 Claims, 5 Drawing Sheets

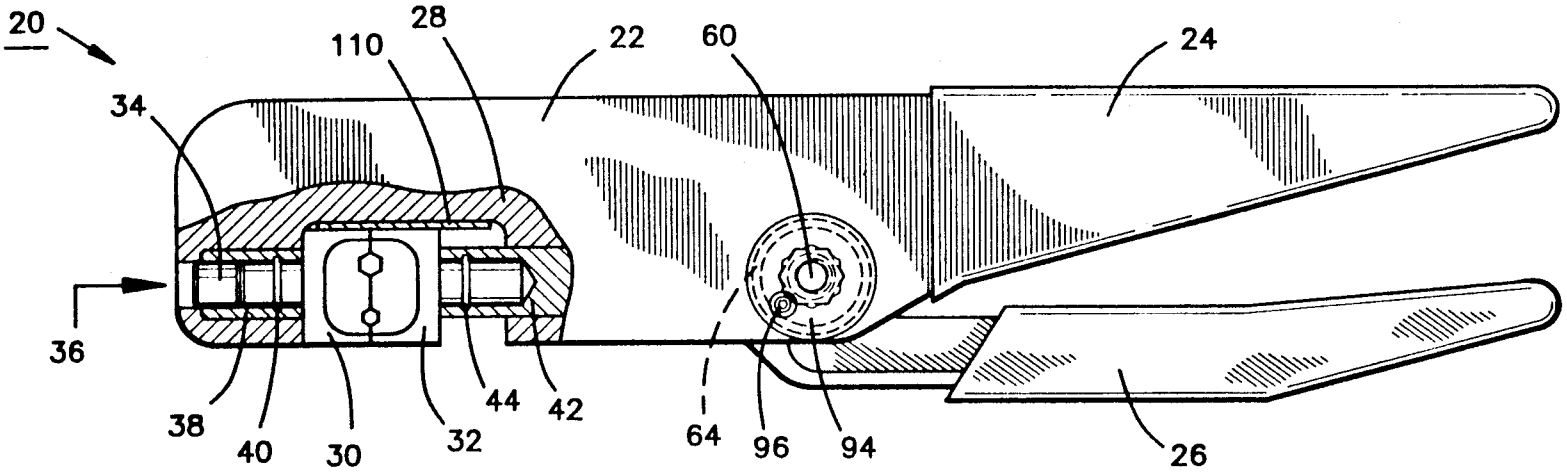
FIG. 3
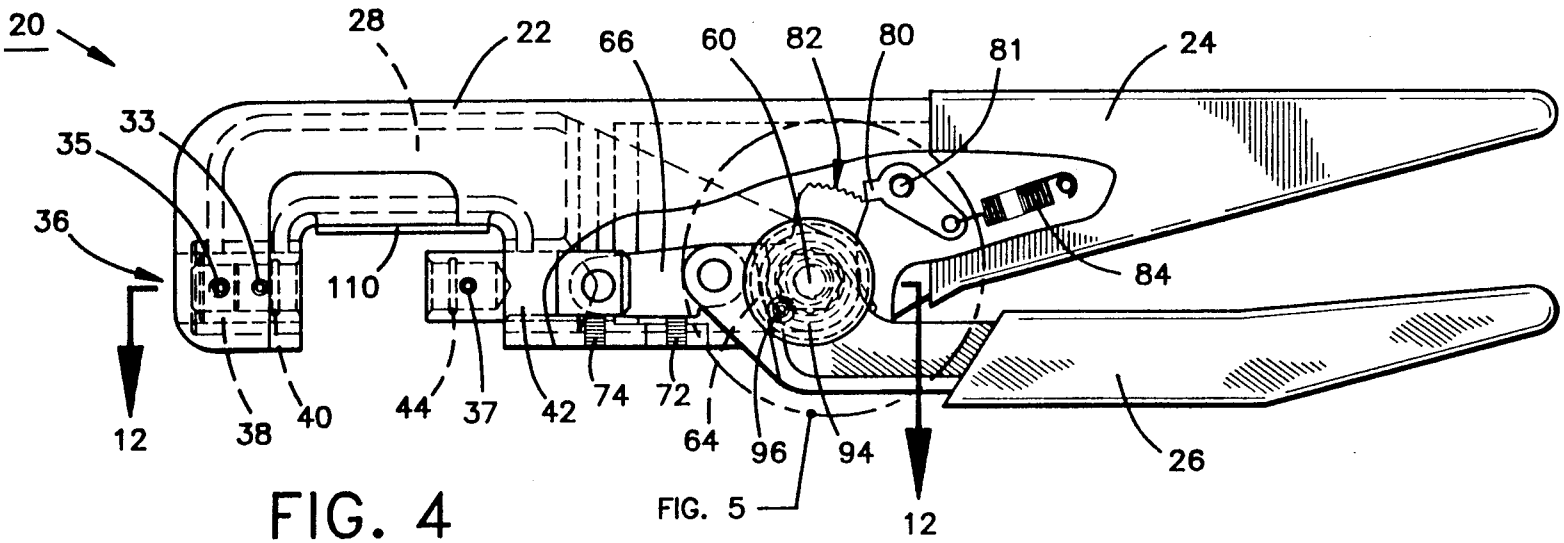
FIG. 5
FIG. 4

MOLDED LIGHTWEIGHT HANDTOOL WITH STRUCTURAL INSERT

This is a continuation-in-part of co-pending application Ser. No. 482,210, filed on Feb. 16, 1990, now abandoned.

BACKGROUND OF THE INVENTION

1. Field of the Invention

The present invention relates to handtools generally and, more particularly, to a novel handtool constructed of molded plastic material and having a metal structural insert located in areas in which the tool experiences high stresses to contain those stresses and maintain alignment of moving parts.

2. Background Art

Handtools are used for a wide range of purposes and the type of handtool under consideration here is one for the crimping of electrical connectors onto the ends of cables. In some cases, such handtools have two jaws, one or both of which are advanced toward each other to crimp the connector onto the end of the cable. In other cases, two die halves are employed, one or both of which are advanced toward each other. In either case, conventional such tools are constructed entirely, or almost entirely, of metal and, since a fairly large amount of metal must be employed to contain the stresses developed during the crimping process, the tools are heavy.

Attempts to construct lightweight such tools of polymeric materials have been unsuccessful, since the stresses developed cause critical portions of the tools to distort dimensionally or even to fail.

It would, therefore, be desirable to provide a handtool which has the strength offered by metal to contain the stresses developed during crimping operations, yet have the lightweightness afforded by the use of polymeric materials.

Accordingly, it is a principal object of the present invention to provide a handtool for crimping electrical connectors onto the ends of cables or similar operations, which handtool combines the lightweightness of polymeric materials with the strength of metallic materials to contain the stresses developed during the crimping or other operations.

It is another object of the invention to provide such a tool that is easily and economically manufactured.

Other objects of the present invention, as well as particular features and advantages thereof, will be elucidated in, or be apparent from, the following description and the accompanying drawing figures.

SUMMARY OF THE INVENTION

The present invention achieves the above objects, among others, by providing, in a preferred embodiment, a handtool for crimping electrical connectors onto the ends of cables or similar operations, which handtool has major portions thereof constructed of a polymeric material. A metal structural insert is provided within the polymeric material to contain a substantially all of the stresses developed by the crimping operations.

BRIEF DESCRIPTION OF THE DRAWING

The invention will be better understood if reference is made to the accompanying drawing figures, in which:

FIG. 3 is a side elevation view, partially in cross-section, of the other side of the tool of FIG. 1, with crimping dies inserted therein, in a closed, or crimping, position.

FIG. 4 is a side elevation view, partially cut-away, of the tool of FIG. 3, with no crimping dies inserted therein.

DETAILED DESCRIPTION OF THE PREFERRED EMBODIMENTS

Figure 1:
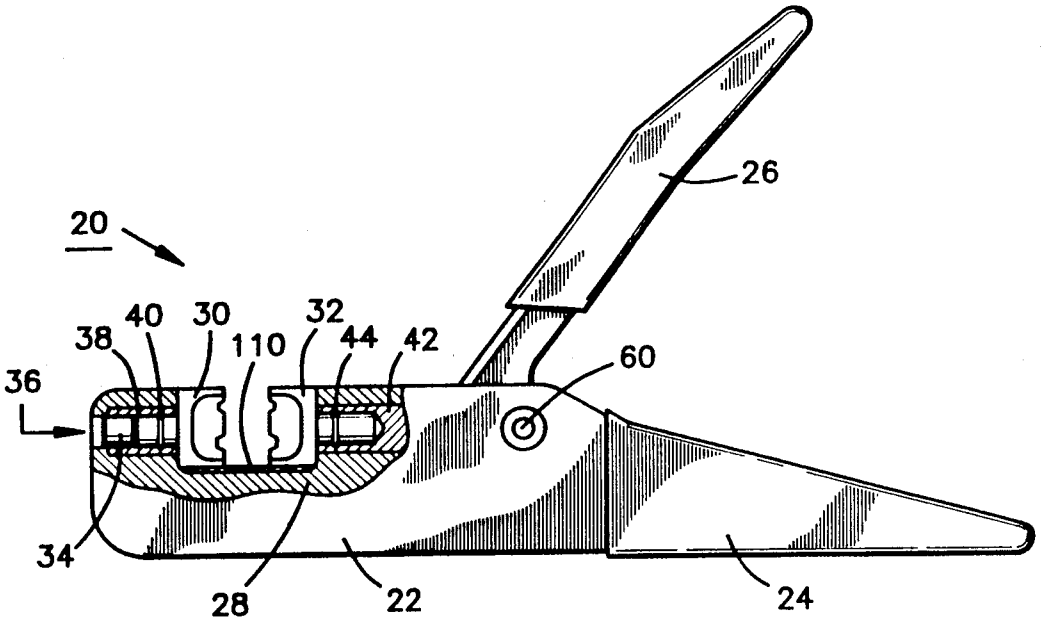
FIG. 1 is a side elevation view, partially in cross-section, of one side of a tool constructed according to the present invention, with crimping dies inserted therein, in an open, or non-crimping, position.

Referring now to the Drawing, in which the same elements are given consistent identifying numerals throughout the various figures thereof, there is shown a tool constructed according to the teachings of the present invention, generally indicated by the reference numeral 20. In this case, tool 20 is a crimping tool having interchangeable crimping dies, although the present invention may be applied easily to any type of tool which is required to lightweight, but which generates internal stresses that cannot be accommodated by an all-polymeric tool.

Parenthetical references to figure numbers direct the reader to the views in which the element(s) being described are best seen, although the element(s) may be seen also in other views.

Tool 20 includes a body of polymeric material 22 (FIGS. 1 and 3), an integral stationary handle also of polymeric material 24 (FIGS. 1–4) having an easily grippable outer covering, and a metallic moveable handle 26 (FIGS. 1–4) also having an easily grippable outer covering.

Figure 2:
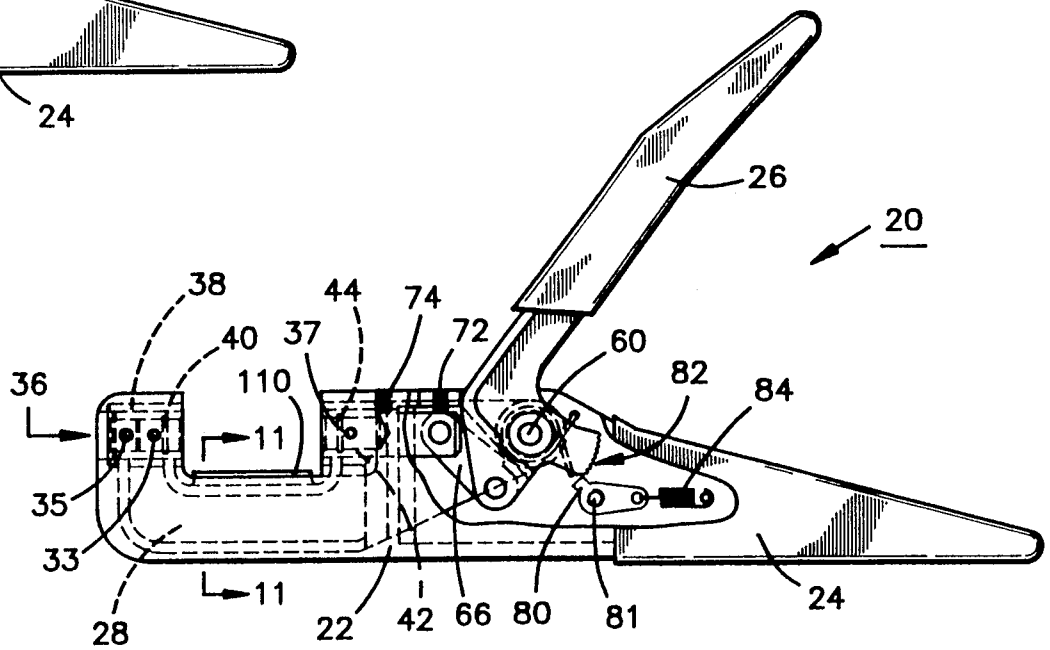
FIG. 2 is a side elevation view, partially cut-away, of the tool of FIG. 1, with no crimping dies inserted therein.
Figure 6:
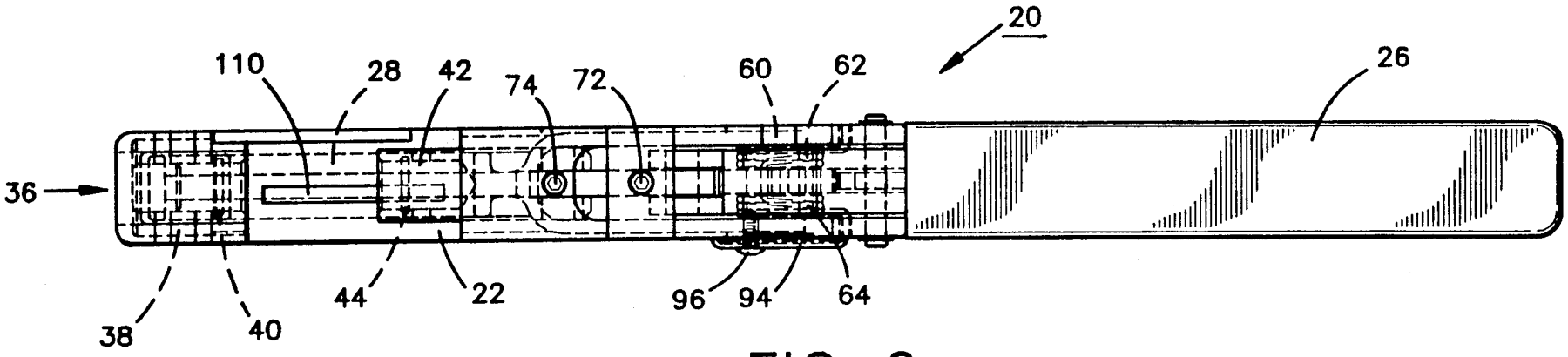
FIG. 6 is a bottom plan view looking up of the tool of FIG. 4.
Figure 5:
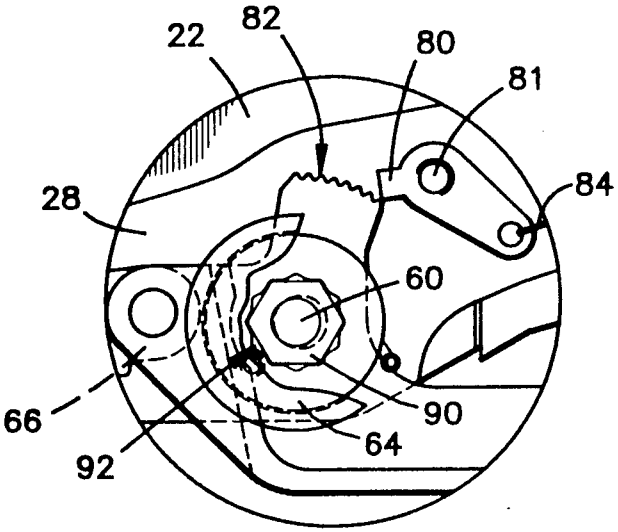
FIG. 5 is an enlarged detail of FIG. 4.

Referring now especially to FIG. 1, tool 20 is shown in its open, or non-crimping position. It can be seen that internally of body 22 is a metallic structural insert 28 (generally seen on all figures - particularly FIGS. 7–9) in bores of which are inserted dies 30 and 32. Die 30 is releasably secured in die receiver 38 by means of a spring clip 40 and die 32 is releasably secured in a slider/die holder 42 by means of a spring clip 44. Die 30 may also be secured by means of a spirol pin 33 (FIGS. 2 and 4). At the distal end of die receiver 40 is a knockout 34 secured loosely in place by means of a spirol pin 35 (FIGS. 2 and 4. Knockout 34 may be provided to provide a member against which a punch may be tapped through opening 36 to loosen die 30 if that die should become stuck in die receiver 38. Die 32 may also be secured in slider/die holder 42 with a spirol pin 37 (FIGS. 2 and 4) which is flush with the outer diameter of slider/die holder 42. (Spirol pins 33, 35, and 37 are not actually shown on FIGS. 2 and 4, but the holes in which they would be placed are indicated by those reference numerals.)

FIG. 3 shows the tool in its closed, or crimping, position wherein dies 30 and 32 have been brought together to crimp a connector onto the end of an electrical cable (neither shown). As indicated with reference to FIGS. 1 and 3, dies 30 and 32 have been brought together by means of the movement of movable handle 26 toward stationary handle 24. Dies 30 and 32 are shown as having a hexagonal crimping pattern, but dies having any desired pattern may be used with tool 20.

The mechanism by which the movement of moveable handle 26 toward stationary handle 24 causes dies 30 and 32 to be brought together may be understood by reference to FIGS. 2, 4, 5, and 12. On those figures, it can be seen that moveable handle 26 is rotatable about an eccentric shaft 60 which is held in structural insert 28 and the movable handle is biased toward its open position by means of coil springs 62 and 64 (shown partially schematically on FIG. 5 for clarity). Rotatably fixed to the inner end of movable handle 26 is one end of an operating link 66, the other end of which operating link is rotatably fixed to the inner end of slider/die holder 42. It can be seen that clockwise rotation of movable handle 26 about eccentric shaft 60, from the position of the handle shown on FIGS. 1 and 2, will cause operating link 66 to rotate counterclockwise about the inner end of slider/die holder 42, thus forcing the slide/die holder to move to the left in the bore defined in structural insert 28 to the position shown on FIGS. 3, 4, and 12. It will be understood that, when crimping a connector, and particularly a large connector, considerable stresses are generated between the various internal components of tool 20, most of which stresses will be contained within structural insert 28.

Overcrimping is prevented by a set screw 72 which bears against the side of operating link 66 (FIGS. 2 and 4) and excessive opening is prevented by a set screw 74 which engages a shoulder formed on slider/die holder 42 when tool 20 has reached its desired open position (FIG. 2).

A pawl 80 (FIGS. 2, 4, and 5) which pivots about a pawl pivot pin 81 is provided to engage a serrated surface 82 on movable handle 26 to ensure even crimping force and to prevent the handle from opening while crimping. Pawl 80 is normally biased away from serrated surface 82 by means of a spring 84 (FIG. 2), but engages the surface when movable handle 26 is rotated clockwise. When die 32 has been advanced a sufficient distance toward die 30, pawl 80 will disengage the last tooth on serrated surface 82 (incipient disengagement shown on FIGS. 4 and 5) and movable handle 26 will be free to return to its open position.

The crimping force provided by tool 20 is adjustable by rotating eccentric shaft 60 (FIGS. 5, 8, and 12) as will now be described. Eccentric shaft 60 includes a hexagonal portion 90 which selectively engages a twelve-point socket 92 integrally formed in structural insert 28. To access eccentric shaft 60, a cover plate 94 is removed after the removal of a retaining screw 96. Eccentric shaft 60 is then lifted from socket 92 and rotated to a selected new position corresponding to the crimping force desired, the shaft is replaced in the socket, and cover plate 94 and retaining screw 96 are replaced.

Figure 8:
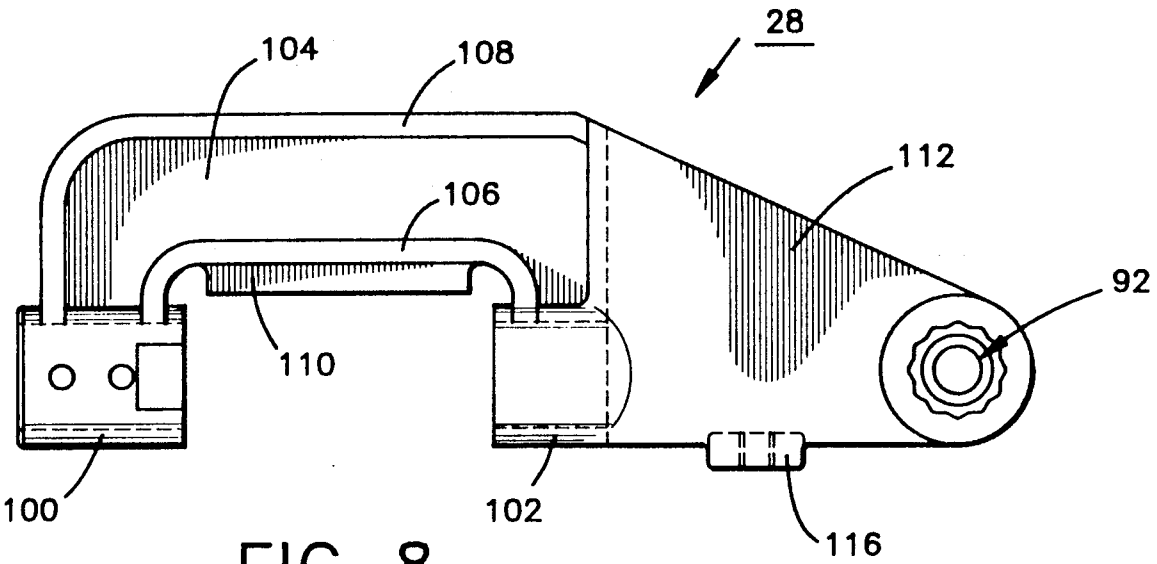
FIG. 8 is a side elevation view of the structural insert of FIG. 7.
Figure 9:
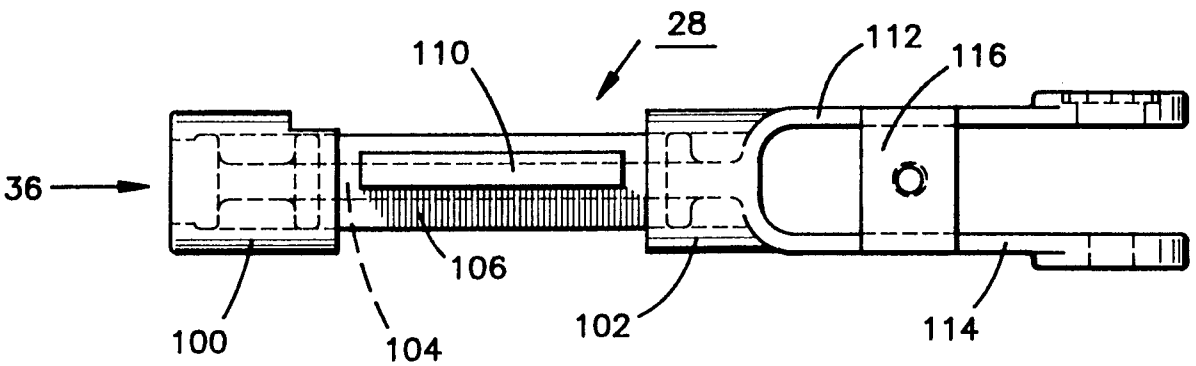
FIG. 9 is a bottom plan view looking up of the structural insert of FIGS. 7 and 8.
Figure 7:
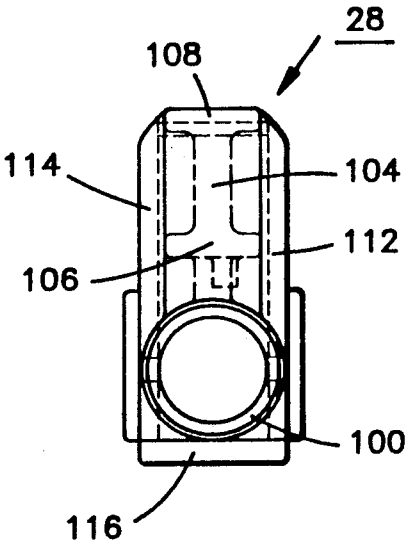
FIG. 7 is a front elevation view of the structural insert of the present invention.
Figure 11:
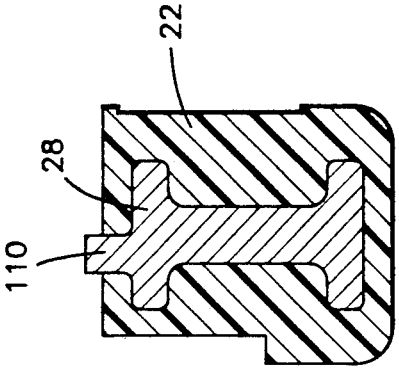
FIG. 11 is a cross-sectional view taken along the line "11—11" of FIG. 2.
Figure 10:
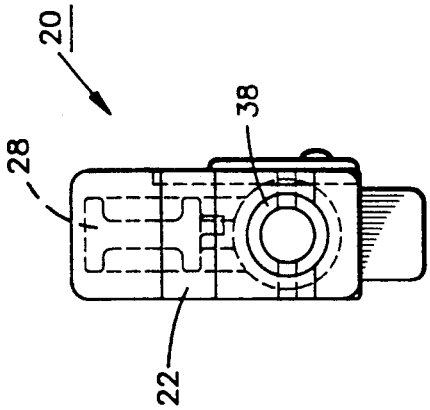
FIG. 10 is a front elevation view of the tool of FIG. 4.
Figure 12:
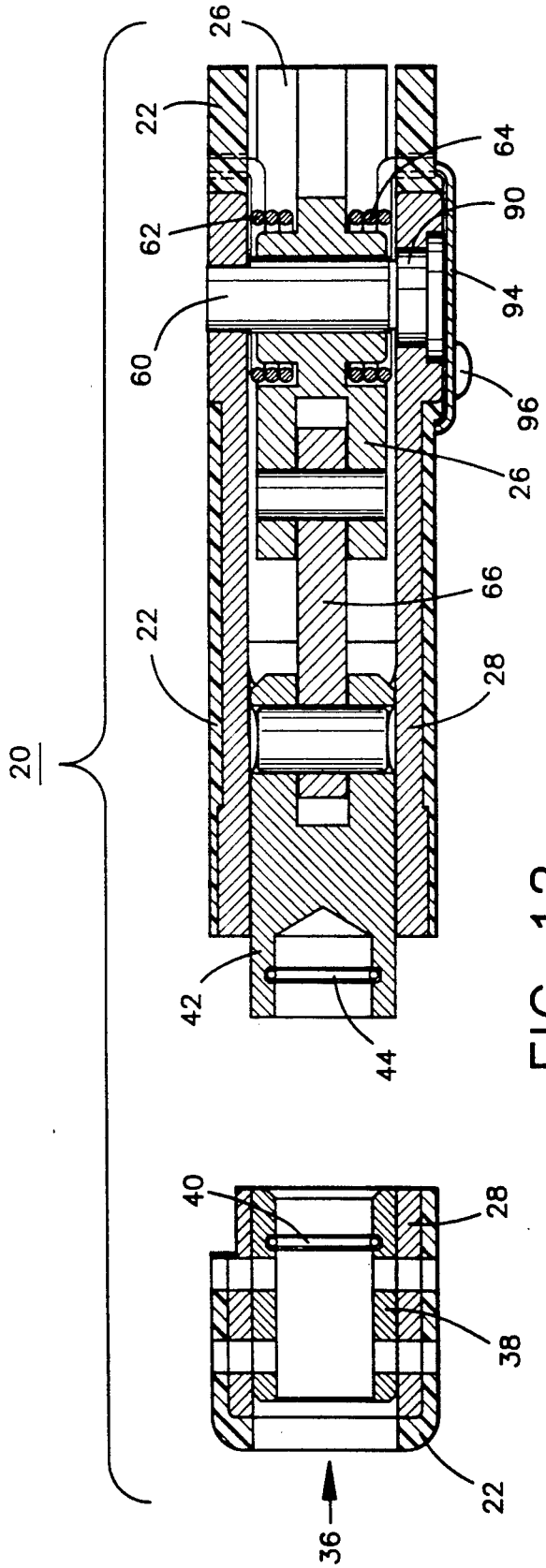
FIG. 12 is a cross-sectional view taken along the line "12—12" of FIG. 4.

Reference now to FIGS. 7-9 will aid in understanding the construction of structural insert 28. Structural insert 28 is elongate and disposed generally along the major axis of elongate body 22 and includes axially aligned bore portions 100 and 102 joined by a web portion 104 having inner and outer flange portions 106 and 108 elements 104, and 106, and 108 comprising a bridge member. Structural insert 28 is thus substantially reinforced against the rotational moment of the crimping forces which would tend to drive apart bore portions 100 and 102. An integral die guide rail 110 is formed at the lower surface of inner flange portion 106 to ensure that dies 30 and 32 remain axially aligned. Two rearwardly extending sidewalls 112 and 114 comprising a strut member, reinforced by cross member 116, join the die holding portion of structural insert 28 with the portion in which eccentric shaft 60 is journaled, thus substantially reinforcing the structural insert against the tensile forces generated by the crimping forces which would tend to separate the shaft from the die holding portion. Thus, the tensile forces created during the crimping process which would otherwise act to force apart eccentric shaft 60 and cylindrical bore portion 100 are contained entirely within structural insert 28 without transfer thereof to polymeric body 22. Structural insert 28 also keeps cylinder bore portions 100 and 102 in alignment.

It can be seen that structural insert 28 provides rigidity of tool 20 in the areas subjected to the greatest stresses, while the plastic of body 22 and stationary handle 24 contribute lightweightness to the tool.

Structural insert 28 can be formed as an investment casting of high-carbon 4140 steel and machined, both using conventional methods. Subsequently, structural insert can be heat treated for hardness and given a black oxide finish for corrosion resistance of exposed parts. Movable handle 26 may also be a similar cast steel. Body 22 and stationary handle 24, with structural insert 28 within the body, can be formed of 30% glass-filled nylon by insert injection molding using conventional methods.

It will thus be seen that the objects set forth above, among those made apparent from the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. A handtool for crimping an electrical connector onto the end of a cable in which a movable first die is advanced toward a fixed second die to crimp an electrical connector therebetween, said handtool comprising:

(a) an elongate body constructed of polymeric material having a major axis;

(b) an elongate structural insert constructed of metallic material disposed within said body, generally aligned with the major axis of said body, such as to contain a substantial portion of the forces developed in said tool as a result of said crimping to prevent dimensional distortion of critical portions of said tool, said structural insert comprising:

(i) first and second bores axially aligned along an axis parallel to the major axis of said body, said first bore being adapted to hold therein a slider, in which said movable first die is fixedly mounted, for back and forth axial movement of said slider therein such that said first die is movable toward and away from said second die along said axis parallel to said major axis of said body, and said second bore being adapted to hold therein said fixed second die;

(ii) an opening defined through said structural insert orthogonal to said axes;

(iii) rotatable means disposed through said opening and operatively connected to said slider such that rotation of said rotatable means causes said back and forth axial movement of said slider;

(iv) said second bore being disposed at the distal end of said structural insert and said opening being disposed at the proximal end of said structural insert so that the full longitudinal dimension of said structural insert is longitudinally bounded by said distal end and proximal end;

(v) said structural insert including a bridge member attached to said first and second bores and extending therebetween spaced apart from the axis of said bore;

(vi) said structural member including a strut member joining said opening with said bridge member and the proximal end of said first bore; and (vii) said structural member extending only its full longitudinal dimension within said body substantially parallel to the major axis of said body;

(c) an integral handle of polymeric material, formed as an extension of said body parallel to the major axis thereof, and extending from the proximal end of said structural insert in an opposite direction to said distal end; and (d) a rotatable handle operatively connected to said rotatable means to effect rotation thereof.

2. A handtool, as defined in claim 1, wherein said rotatable handle is formed from a metallic material.

3. A handtool, as defined in claim 1, wherein said rotatable means is an eccentric shaft.

4. A handtool, as defined in claim 1, wherein said eccentric shaft includes a portion thereof having a plurality of protrusions extending orthogonally from the longitudinal axis of said shaft, said protrusions being selectively engagable with a plurality of detents formed in a socket in said structural inset, such that the force of said crimping may be adjusted by changing the engagement of said protrusions with said detents.

5. A handtool, as defined in claim 1, wherein said bridge member has an I-beam configuration in cross-section.

6. A handtool, as defined in claim 1, wherein said strut member includes two parallel walls extending parallel to the major axis of said body.

* * * * *